United States Patent [19]

Turek

[11] 4,004,618

[45] Jan. 25, 1977

[54] CABLE TIE BRAKING MEANS IN A CABLE TIE INSTALLATION TOOL

[75] Inventor: James A. Turek, La Grange, Ill.

[73] Assignee: Panduit Corporation, Tinley Park, Ill.

[22] Filed: Dec. 29, 1975

[21] Appl. No.: 644,398

[52] U.S. Cl. ..... 140/93.2; 140/93 A

[51] Int. Cl.[2] ..... B21F 9/02

[58] Field of Search ..... 140/93 A, 93.2, 123.6; 221/193

[56] References Cited

UNITED STATES PATENTS

| | | | |
|---|---|---|---|
| 3,515,178 | 6/1970 | Hidassy | 140/93.2 |
| 3,633,633 | 1/1972 | Countryman | 140/93.2 |
| 3,891,012 | 6/1975 | Bakermans | 140/93.2 |

*Primary Examiner*—Lowell A. Larson
*Attorney, Agent, or Firm*—Richard B. Wakely; Charles R. Wentzel

[57] ABSTRACT

An improvement in a cable tie installation tool. The tool includes a tool member for fastening a cable tie about a bundle of wires or the like, conveyor means connected to the tool member, and propulsion means for propelling a cable tie through the conveyor means to the tool member. The tool member includes a positioning means for placing the tie about the bundle, a tube receiving the cable tie from the conveyor means and transmitting the tie toward the positioning means, and stop means engagable with the head of the tie for limiting movement of the head toward the positioning means. The improvement comprises braking means for decelerating the tie as it passes through the tube and before the tie head reaches the stop means whereby the likelihood of damage to the tie head upon engagement with the stop means is reduced and the service life of the stop means is extended.

10 Claims, 9 Drawing Figures

CABLE TIE BRAKING MEANS IN A CABLE TIE INSTALLATION TOOL

BACKGROUND OF THE INVENTION

This invention relates to an automatic cable tie installation tool and more particularly to such a tool having a braking means for decelerating a cable tie being conveyed within the tool.

An automatic cable tie installation tool for affixing a self-locking cable tie about a bundle or wires or the like has recently been placed in service. This tool is the subject of commonly assigned U.S. patent application Ser. No. 450,523, filed Mar. 12, 1974, now U.S. Pat. No. 3,946,769 and comprises a tool member and a remotely positioned cable tie dispenser interconnected by a flexible conveyor member or hose. A cable tie is propelled strap portion first from the dispenser by means of fluid pressure introduced behind the head of the cable tie and is received by a cable tie tube or chute in the tool member which guides the tie toward a pair of jaw members which in turn position the tie about the wires to be bundled. The tool member also includes a cable tie head stop disposed between the tube and the jaw members to limit movement of the cable tie head toward the jaw members thereby ensuring the head aperture is properly aligned to receive the leading end of the strap.

As the cycle of operation of the installation tool is very fast (less than a second elapses from the time the tool is actuated until the cable tie is tightened and the excess portion of the strap severed), the cable tie must be moved from the dispenser and through the hose and cable tie tube at relatively high velocity. It occasionally happens that upon impact with the stop, the head of the cable tie is damaged thereby making the tie unusable. It is also possible for a fragment of a shattered head to become lodged in the drive mechanism for the jaw members thereby jamming the tool and necessitating disassembly thereof.

It is also conceivable that as the jaw members move to tighten the tie about the wires, the cable tie head, due to the resiliency of the strap, might slide out of engagement with the stop and move slightly back into the cable tie tube. If this occurred, the head aperture would not be properly aligned to receive the strap and the strap could not be properly threaded.

SUMMARY OF THE INVENTION

Among the several objects of this invention may be noted the provision of an improvement in an automatic cable tie installation tool; the provision of such an improvement which decelerates a cable tie as it approaches the jaw members and cable tie head stop to preclude high-speed impact of the head against the stop; the provision of such improvement which retains the cable tie head in proper position to receive the leading end of the strap; and the provision of such an improvement has long service life, is easily mounted in the tool member, and is simple and economical to manufacture. Other objects and features of the present invention will be in part apparent and in part pointed out hereinafter in the specification and in the claims attendant thereto.

Briefly, the present invention concerns an improvement in a cable tie installation tool which includes a tool member, cable tie conveyor means, and means for propelling a cable tie through the conveyor means to the tool member. The tool member includes cable tie positioning means, a cable tie receiving tube, and stop means engageable with the cable tie head for limiting movement thereof toward the positioning means. The improvement includes braking means for decelerating the cable tie as it passes through the tube and before the head of the tie reaches the stop means whereby the likelihood of damage to the head upon engagement with the stop means is reduced and the service life of the stop means is extended.

BRIEF DESCRIPTION OF THE DRAWINGS

Corresponding reference characters indicate corresponding parts throughout the several views of the drawings.

DESCRIPTION OF THE PREFERRED EMBODIMENT

Figures 1, 2:
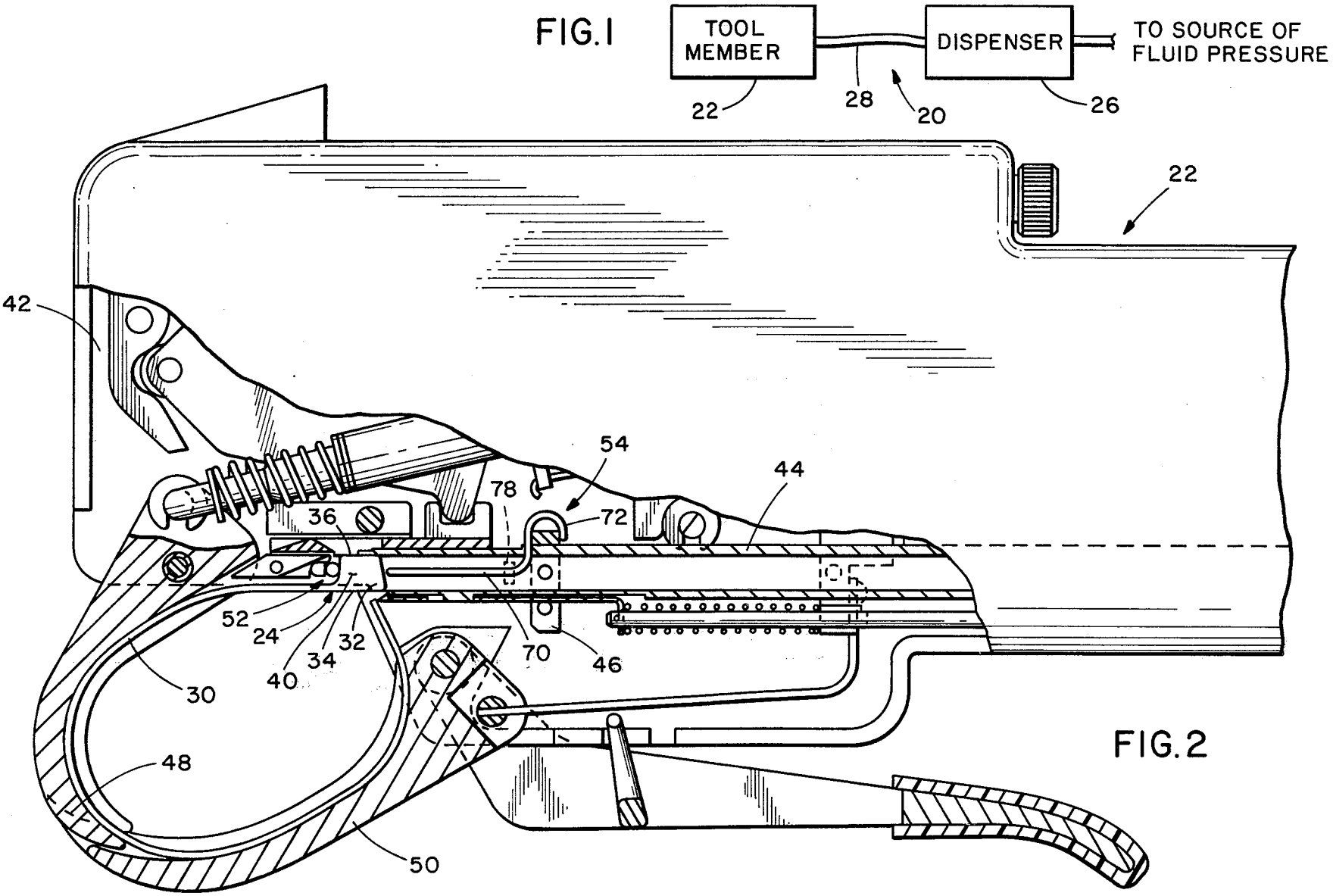
FIG. 1 is a block diagram of an automatic cable tie installation tool comprising a tool member and a cable tie dispenser interconnected by a flexible conveyor member.
FIG. 2 is a fragmentary sectional view of the tool member with certain components removed showing a cable tie braking means positioned in the tool member and extending into a cable tie tube.

Referring now to the drawings, a block diagram of an automatic cable tie installation tool 20 is shown in FIG. 1. Tool 20 includes a tool member 22 adapted to position and tighten a self-locking cable tie 24, shown in FIGS. 2 and 7–9, about a bundle of wires, a cable tie dispenser 26 remotely mounted from tool member 22, and a flexible conveyor or hose 28 interconnecting the tool member and the dispenser. Dispenser 26 includes cable tie propulsion means (not shown) for connection to a source of fluid pressure and adapted to selectively propel a cable tie 24 from dispenser 26 through hose 28 and into tool member 22. For a more complete understanding of the components and operation of tool 20, reference may be made to commonly-assigned U.S. patent application Ser. No. 450,523, filed Mar. 12, 1974.

As shown in FIGS. 2 and 7–9, cable tie 24 includes an elongate flexible strap 30 for positioning about the bundle and a locking head 32 extending from the strap for receiving and securely holding the free end of the strap. Head 32 includes a strap entry face 34, a strap exit face 36, and a strap-receiving aperture 38 extending between the faces. Head 32 also comprises side walls 40 extending generally parallel to the longitudinal direction of the strap, as-molded, and partially defining aperture 38. The length of head 32 is defined as the extension of the head in the longitudinal direction of the strap while the height of the head is the maximum spacing between the strap entry and strap exit faces and the width of the head is the distance between the outside surfaces of respective side walls 40. Such a cable tie is fully disclosed in commonly-assigned U.S. Pat. No. 3,872,547.

As shown in FIG. 2, tool member 22 comprises a housing 42 which serves as a mounting frame for other components of the tool member. The tool member also includes a cable tie tube 44, best shown in FIG. 6, for receiving a cable tie conveyor 28. Tube 44 is held in place by means of a tube support block 46. It should be appreciated that the rectangular cross-sectional configuration of the tube cooperates with the cable tie head configuration to maintain the desired orientation of cable tie 26 as it is guided strap portion first through the tube.

The tool member 22 also comprises means for positioning the strap of the cable tie about the bundle including a pair of relatively movable curved jaw members 48, 50. It will be appreciated that the jaw members each have an interior slot to receive the strap portion of the cable tie and guide it about the wires to be bundled. The tool member further comprises stop means 52, best shown in FIGS. 7–9, engagable with the head of the cable tie and disposed in the path of travel of the cable tie between tube 32 and the positioning means for limiting movement of the head towards the positioning means. The improvement of the present invention comprises braking means 54, best shown in FIGS. 3–5, for decelerating the cable tie as it passes through the tube and before the head of the tie reaches the stop means so that the likelihood of damage to the head upon engagement with stop means 52 is reduced.

Figure 6:
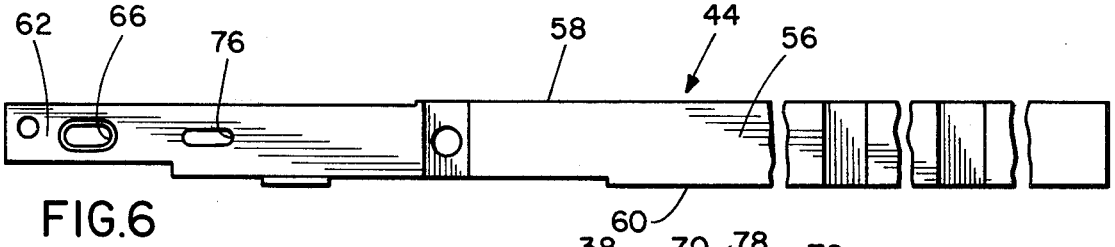
FIG. 6 is a front elevational view of the cable tie tube.

More specifically, as shown in FIG. 6, cable tie tube 44 has side walls 56 and top and bottom walls 58, 60 respectively. Side walls 56 each have an extension 62 serving as supports for the stop means 52. Stop means 52 comprises a pair of metallic fingers 64, see FIGS. 7–9, with each finger extending through a respective oblong aperture 66 in each extension 62. Each finger bears against a respective resilient cushion or shock absorber 68, preferably fabricated of rubber, each of which is disposed in a respective aperture 66 between the distal end of the extension 62 and the finger 64 so that the finger is slidable in the aperture against the resistance of its shock absorber.

Figure 3:
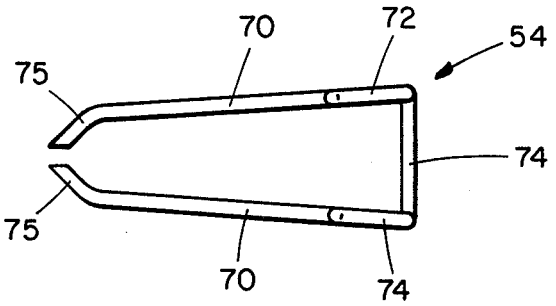
FIG. 3 is a plan of the braking means of the present invention.
Figure 4:
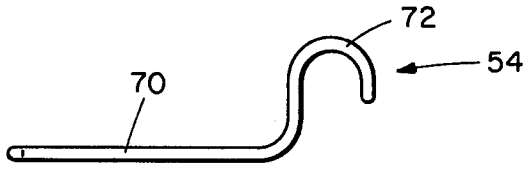
FIGS. 4 and 5 are, respectively, front elevational and side elevational views of the FIG. 3 braking means.
Figure 5:
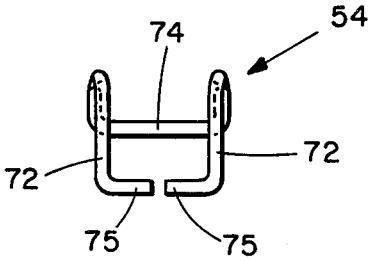

Referring to FIGS. 3–5, braking means 54 is integral, is preferably fabricated from spring steel such as music wire, and comprises means for mounting the braking means on support block 46 and further includes means, comprising a pair of resilient arms 70, for interfering with the cable tie head 32 as the cable tie passes through the cable tie tube 44. The mounting means includes a pair of spaced legs 72 each in the shape of an inverted J with the ends of the hooked portions of the legs joined by a transverse support 74. The legs 72 are resilient and compressively hold the top of support block 46 between their stem and hook portions. One arm 70 extends as a cantilever from the stem portion of each leg 72 in the longitudinal direction of tube 44 adjacent the outside surface of a respective tube side wall 56. Each arm 70 includes a tip portion 75 bent out of the longitudinal direction of the arm and extending through a respective elongated aperture 76 in each of the tube side walls 56.

Figure 7:
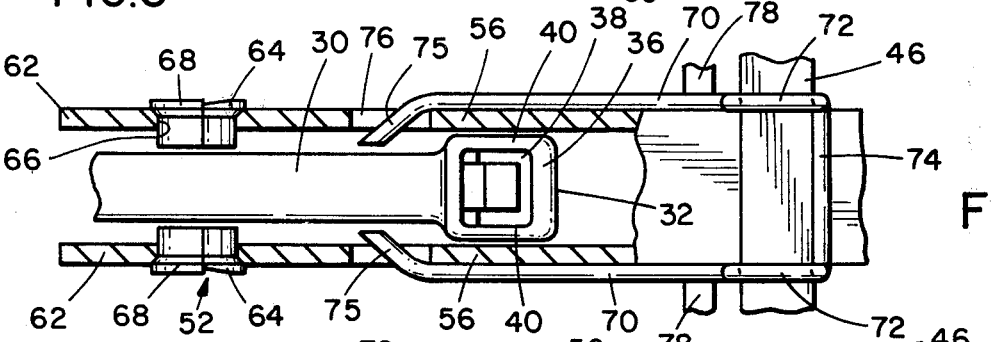
FIG. 7 is a plan of the tube holding the braking means, with certain parts removed showing the head of a cable tie approaching the braking means.

The tip portions 75 converge in the direction of travel of the cable tie through the tube and they are biased by their respective arms 70 to a first position, as shown in FIG. 7, wherein the spacing between the ends of the tip portions is substantially less than the width of the cable tie head. Tip portions 75 are deflectable by the head of the cable tie to a second position, shown in FIG. 8, wherein the spacing between their ends is substantially equal to the width of the cable tie head so that it is enabled to pass therebetween. It is noted that the tip portions are positioned in the tube so that they interfere only with the cable tie head and not the strap. When in their first or biased position, the distance between the ends of the tip portions 75 and stop means 52 is slightly greater than the length of the cable tie head. Of course, since the tip portions converge in the direction of travel of the cable tie once the head passes the tip portions and they return to their biased positions, the head is unable to return down the tube past the tip portion ends and they can be considered to constitute gate means. It should be appreciated that once the braking means is properly positioned within tool member 22, support block 46 prevents movement of the braking means in the longitudinal direction of the tube while the surfaces of side walls 56 defining apertures 76 prevent significant transverse movement of the mounting means.

Figure 8:
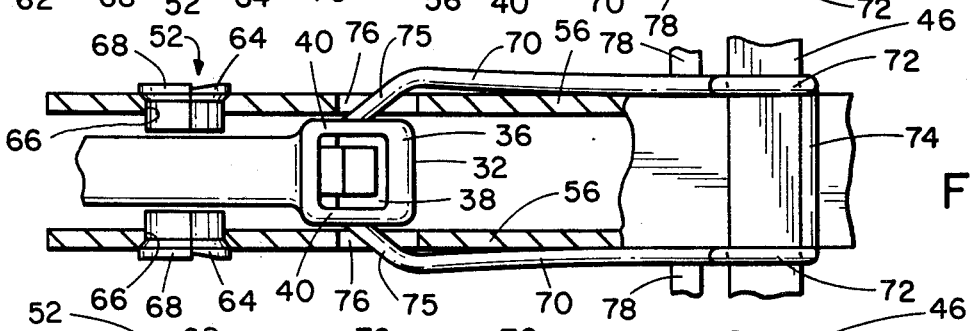
FIG. 8 similar to FIG. 7, illustrates the cable tie head engaging and deflecting the braking means out of the path of the tie.
Figure 9:
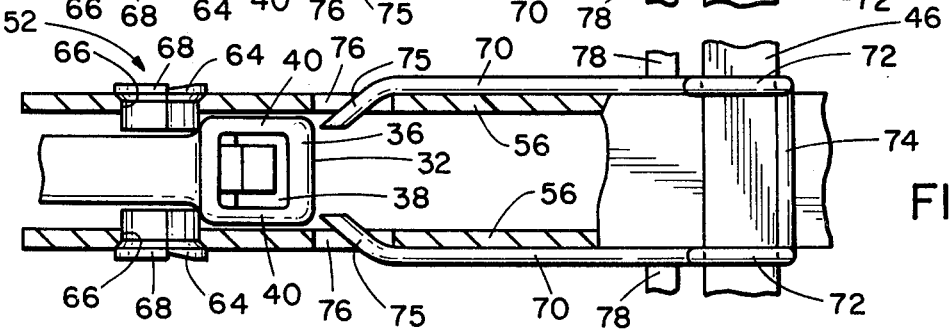
FIG. 9, also similar to FIG. 7, illustrates gate means of the braking means in position to abut the cable tie head thereby to prevent retrograde movement thereof in the cable tie chute.

Operation of the braking means of the present invention is as follows: Referring to FIG. 7, the tip portions 75 of arms 70 are in their biased or first position as the cable tie is propelled down tube 44 towards stop means 52. As shown in FIG. 8, the cable tie head engages the tip portions and deflects them outwardly toward their second position wherein the spacing between the tip portion ends is substantially equal to the head width. Of course, the cable tie head must perform work to deflect the tip portions 75 against the bias of their respective arm 70. This causes dissipation of some of the kinetic energy of the cable tie causing deceleration thereof. After the tip portions have been moved to their second position, the tip portion ends drag against the side walls 40 of the head 32 causing further deceleration of the cable tie. As the speed of the cable tie has been substantially reduced, the possibility of head fragmentation upon impact with the stop means has been greatly reduced and the service life of the stop means extended. Referring to FIG. 9, when head 32 has passed tip portions 75, they return to their biased position and the tip portion ends serve as abutments to prevent retrograde movement of the head. Thus, the head is captively held between the fingers 64 of the stop means and the tip portion ends so the strap-receiving aperture 38 of head 32 is properly aligned to receive the free end of strap 30 from the jaw members.

Housing 42 is preferably provided with abutments 78 extending to engage each arm 70 adjacent legs 72. Abutments 78 function to limit substantial flexing of the braking means to the portions of arms 70 between the abutments and the tip portions 75 and reduce flexing in the mounting means portion of the braking means which is more susceptible to fatigue failure than the generally straight arms.

In view of the above, it will be seen that the several objects of the invention are achieved and other advantageous results attained.

As various changes could be made in the above constructions without departing from the scope of the invention, it is intended that all matter contained in the above description shall be interpreted as illustrative and not in a limiting sense.

What is claimed is:

1. An improvement in a cable tie installation tool which includes a tool member for fastening a cable tie about a bundle of wires or the like, conveyor means connected to said tool member, and propulsion means for propelling a cable tie through said conveyor means to said tool member, said tool member having positioning means for placing said cable tie about said bundle, a tube receiving said cable tie from said conveyor means and guiding the tie toward said positioning means, and stop means engagable with the head of said tie for limiting the movement of said head toward said positioning means, said improvement comprising:

braking means for decelerating said cable tie as it passes through said tube and before the head of the tie reaches said stop means whereby the likelihood of damage to said head upon engagement with said stop means is reduced and the service life of said stop means is extended.

2. A tool as set forth in claim 1 wherein said braking means comprises means for interfering with the head of said cable tie as it passes through said tube.

3. A tool as set forth in claim 1 wherein said braking means is disposed in the path of travel of said cable tie before said stop means and comprises gate means for preventing the head of said tie, after having passed said braking means, from returning through said tube past the braking means toward said conveyor means whereby said head is captively retained between said stop means and said gate means.

4. A tool as set forth in claim 1 wherein said braking means is integral and fabricated of spring steel.

5. A tool as set forth in claim 1 wherein one wall of said tube has an aperture therethrough, said braking means including a resilient arm extending through said aperture in the direction of the travel of said tie and toward a wall of said tube opposite said one wall.

6. A tool as set forth in claim 5 wherein opposing walls of said tube have opposed apertures, said braking means comprising a pair of resilient arms with each of said arms extending through a respective one of said apertures and with said arms converging in the direction of travel of said tie, the free ends of said arms being movable between a first position wherein the spacing therebetween is substantially less than the width of said cable tie head and a second position wherein the spacing between the free ends is substantially equal to the head width, said free ends being biased to their first position whereby said arms interfere with said head as the tie passes through said tube thereby slowing the tie as the head deflects the free arms toward their second position and whereby, upon said head passing the free ends of the arms, the free ends return to their first position wherein they serve to abut the head and prevent retrograde movement of the tie toward the conveyor means.

7. A tool as set forth in claim 1 wherein said braking means comprises mounting means adapted to be mounted on a support in said tool member.

8. A tool as set forth in claim 7 wherein said mounting means is fabricated of spring steel and comprises at least one leg in the shape of an inverted J, said leg compressively holding said support between the hook portion and the stem portion of said leg.

9. A tool as set forth in claim 8 wherein said mounting means comprises a pair of spaced legs with the ends of the hook portions of the legs joined by a transverse support member, said braking means further comprising a pair of arms for engaging the head of the cable tie with one arm extending as a cantilever from the stem portion of each leg.

10. A tool as set forth in claim 8 wherein said tool member further comprises a housing serving as a mounting frame for other components of said tool member and wherein said braking means further includes a resilient arm extending as a cantilever from said leg and including a tip portion engagable with the head of said cable tie, said housing including an abutment engaging said arm adjacent said leg to limit substantial flexing of said braking means to said arm.

* * * * *